US005226087A

United States Patent [19]

Ono et al.

[11] Patent Number: 5,226,087

[45] Date of Patent: Jul. 6, 1993

[54] MICROPHONE APPARATUS

[75] Inventors: Kiminori Ono, Katano; Michio Matsumoto, Sennan; Hiroyuki Naono, Yawata; Hiroshi Kobayashi, Moriguchi; Yuji Yamashina, Takatsuki, all of Japan

[73] Assignee: Matsushita Electric Industrial Co., Ltd., Osaka, Japan

[21] Appl. No.: 870,631

[22] Filed: Apr. 20, 1992

[30] Foreign Application Priority Data

Apr. 18, 1991 [JP] Japan ..... 3-086960
Apr. 22, 1991 [JP] Japan ..... 3-090382

[51] Int. Cl.[5] ..... H04R 3/00
[52] U.S. Cl. ..... 381/92; 381/26
[58] Field of Search ..... 381/92, 26, 94, 122

[56] References Cited

U.S. PATENT DOCUMENTS 4,354,059 10/1982 Ishigaki et al. ..... 387/92

FOREIGN PATENT DOCUMENTS 56-89194 7/1981 Japan ..... 381/92
56-116396 9/1981 Japan ..... 381/92
58-33396 2/1983 Japan ..... 381/92
2-217100 8/1990 Japan ..... 381/26

*Primary Examiner*—Forester W. Isen
*Attorney, Agent, or Firm*—Wenderoth, Lind & Ponack

[57] ABSTRACT

A microphone apparatus comprises two non-directional microphones in case of monaural sound pickup or three non-directional microphones in case of stereo sound pickup, and a signal processing means for processing output signals of the non-directional microphones so that a directivity becomes non-directional in a low frequency region and a first order pressure gradient type in a high frequency region. Accordingly, the microphone apparatus can attenuate the level of unwanted acoustic and vibration noises caused by its onboard moving mechanism as well as wind noise, thus ensuring no declination in the S/N ratio during sound pickup action.

2 Claims, 2 Drawing Sheets

MICROPHONE APPARATUS

BACKGROUND OF THE INVENTION

1. Field of the Invention

The present invention relates to a microphone apparatus built into an appliance which contains an acoustic noise or vibration source.

2. Description of the Prior Art

In collecting sound with a microphone, their resultant audio signals are frequently deteriorated in quality due to unwanted acoustic and vibration noises caused by the mechanical vibrations and wind noise. In particular, such an appliance as video camera produces a degree of unwanted noise and mechanical vibration depending on its moving mechanism contained in an enclosure. In common, when a noise source is located in a given direction for a microphone, a directional type microphone is employed and arranged to exhibit low sensitivity in the direction of the noise source and thus, permits its desired audio signal to be minimum affected by a noise from the noise source. For stereo sound recording, the use of directional microphones is essential. The disadvantage of such directional microphones mounted on the video camera is that the S/N ratio of a sound signal to be recorded is declined by the following facts.

The directional microphones are arranged adjacent to the noise source of the video camera and will be much affected by noise sounds from the noise source due to its proximity effect.

The directional microphones tend to be more affected by vibrations than non-directional microphones.

The directional microphones tend to be more affected by wind blow than non-directional microphones.

Some modified directional microphones capable of attenuating wind noises have been introduced. Such a microphone apparatus is disclosed in Japanese Patent Application Publication H01-39174 or 39195 (1989), which comprises a non-directional microphone, a unidirectional microphone, a lowpass filter for elimination of high frequency components of an output signal from the non-directional microphone, a lowpass filter for elimination of low frequency components of an output signal from the unidirectional microphone, an adder for summing two output signals of their respective filters, and a determining means for calculating the level of a wind noise.

In operation of the microphone apparatus, the output signal of the unidirectional microphone is selected for transmission if the wind noise level calculated by the determining means is low. If it is high, a sum signal of a high frequency component of the output signal of the unidirectional microphone and a low frequency component of the output signal of the non-directional microphone is selected for transmission. Accordingly, the microphone apparatus will be less affected by the wind noise than a traditional unidirectional microphone.

Although such a conventional microphone apparatus is capable of attenuating the level of an unwanted wind noise, when installed in a video camera, it is impossible to reduce the acoustic noise increasing due to the proximity effect and vibration noise when the level of wind noise is low.

SUMMARY OF THE INVENTION

It is an object of the present invention to provide an improved microphone apparatus capable of attenuating the level of acoustic and vibration noises caused by its onboard moving mechanism as well as of wind noise thus to prevent declination in the S/N ratio of a recording signal of sounds picked up.

A microphone apparatus according to the present invention comprises two non-directional microphones in case of monaural sound pickup or three non-directional microphones in case of stereo sound pickup, and a signal processing means for processing output signals of the non-directional microphones so that a directivity becomes non-directional in a low frequency region and a first order pressure gradient type in a high frequency region.

Accordingly, the microphone apparatus of the present invention can attenuate the level of unwanted wind noise and acoustic and vibration noises caused by its onboard moving mechanism, thus ensuring no declination in the S/N ratio during sound pickup action.

DESCRIPTION OF THE PREFERRED EMBODIMENTS

Embodiments of the present invention will be described referring to the accompanying drawings.

Figure 1:
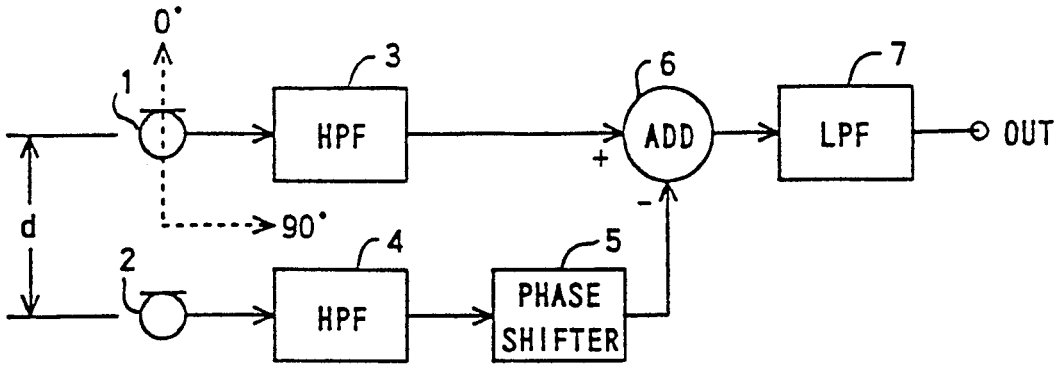
FIG. 1 is a block diagram of a microphone apparatus showing a first embodiment of the present invention.

FIG. 1 is a diagram of a microphone apparatus showing a first embodiment of the present invention. In the following description, a mechanical system contained in an appliance in which the microphone apparatus is incorporated will be referred to as an acoustic noise or vibration source. As shown in FIG. 1, there are provided a couple of non-directional microphones 1 and 2, a highpass filter 3 for eliminating a low frequency component of an output signal of the non-directional microphone 1, another highpass filter 4 for eliminating a low frequency component of an output signal of the other non-directional microphone 2, a phase shifter 5 for phase shifting an output signal of the highpass filter 4, a subtractor 6 for subtracting a phase shifted signal of the phase shifter 5 from an output signal of the highpass filter 3, and a lowpass filter 7 for eliminating a high frequency component of an output signal of the subtractor 6. When the cutoff frequencies of the highpass filters 3,4 and the lowpass filter 7 are $f_{c3}$, $f_{c4}$, and $f_{c7}$ respectively, they are expressed as:

$$f_{c4} < f_{c3} < f_{c7} \quad (1)$$

The operation of the microphone apparatus of the first embodiment in the frequency range not less than $f_{c3}$ will now be explained. As an output signal of the non-directional microphone 2 is delayed by a phase shift which corresponds to the distance d between the two non-directional microphones 1 and 2 and subtracted from a high frequency component, not less than $f_{c3}$, of the output of the non-directional microphone 1, the microphone apparatus of the first embodiment becomes a first order pressure gradient type within the high frequency band. The directivity D is obtained from a function of the angle $\theta$ between the main axis of the microphone apparatus and the direction of sound wave propagation, which is expressed as:

$$D(\theta) = \frac{\alpha + \cos\theta}{\alpha + 1} \quad (2)$$

Also, $\alpha$ in the equation (2) is calculated from:

$$\alpha = \frac{C\tau}{d} \quad (3)$$

(where c is the velocity of sound and d is the distance between the two microphones 1,2)

Hence, the microphone apparatus becomes bi-directional when $\alpha=0$, uni-directional when $\alpha=1$, and non-directional when $\alpha=\infty$. In the equation (3), $\tau$ is a parameter for determining a transfer function of the phase shifter 5. As the phase shifter 5 produces a phase shift of $\omega\tau$, the directivity of the microphone apparatus can be altered by varying the parameter $\tau$ for avoiding the noise source.

In the frequency range of less than $f_{c3}$, the output of the subtractor 6 becomes almost equal to that of the phase shifter 5 and the directivity of the microphone apparatus will be non-directional.

Figure 2A:
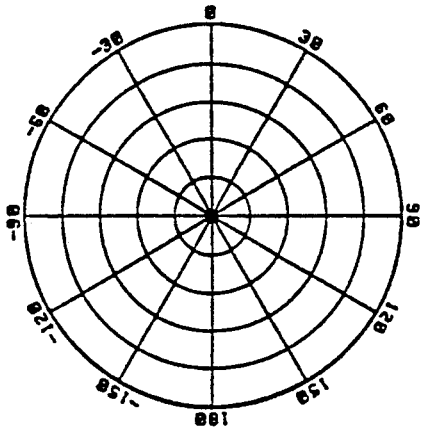
FIG. 2*a* is a diagram showing a directivity pattern of the microphone apparatus of FIG. 1 in a low frequency region.
Figure 2B:
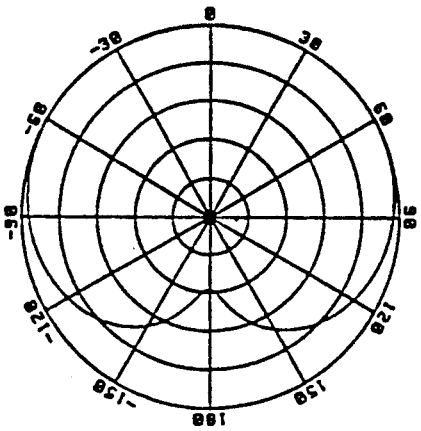
FIG. 2*b* is a diagram showing a directivity pattern of the microphone apparatus of FIG. 1 in a high frequency region.
Figure 2C:
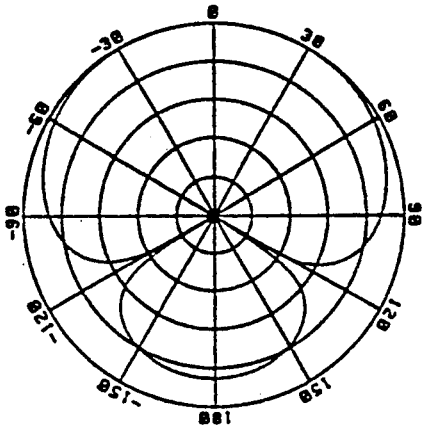
FIG. 2*c* is a diagram showing another directivity pattern of the microphone apparatus of FIG. 1 in the same high frequency region.

FIG. 2*a* illustrates a directivity pattern of the microphone apparatus of the first embodiment for response to a lower frequency range than $f_{c3}$. FIG. 2*b* illustrates a directivity pattern of the microphone apparatus in a higher frequency range than $f_{c3}$ when $\tau=d/c$. Also, FIG. 2*c* illustrates another directivity pattern of the microphone apparatus in the higher frequency range than $f_{c3}$ when $\tau=d/(2c)$.

As described, the microphone apparatus of the first embodiment can attenuate the unwanted wind and vibration noise which is commonly low in the frequency to as a low level as of a non-directional microphone and simultaneously, its directivity in a high frequency range remains not affected by the distance of the microphones from the noise source so that the noise level of the high frequency range can be maintained at a minimum.

Figure 3:
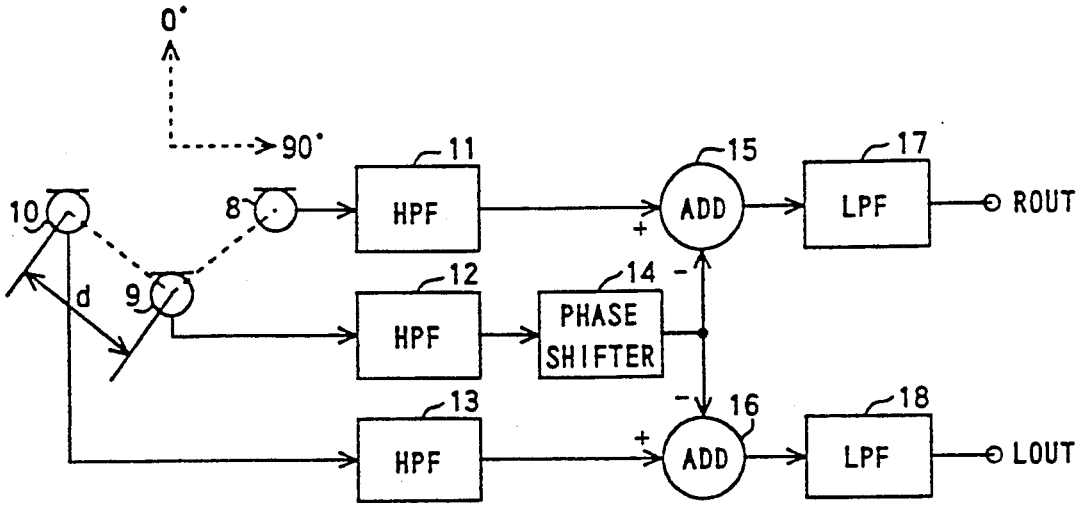
FIG. 3 is a block diagram of a microphone apparatus showing a second embodiment of the present invention.

FIG. 3 is a diagram of a microphone apparatus showing a second embodiment of the present invention. As shown, there are provided three non-directional microphones 8,9,10, three highpass filters 11,12,13 for eliminating low frequency components of output signals of the non-directional microphones 8,9,10 respectively, a phase shifter 14 for phase shifting an output signal of the highpass filter 12, a subtractor 15 for subtracting a phase shifted signal of the phase shifter 14 from an output signal of the highpass filter 11, another subtractor 16 for subtracting the phase shifted signal of the phase shifter 14 from an output signal of the highpass filter 13, and two lowpass filters 17,18 for eliminating high frequency components of output signals of the subtractors 15,16 respectively. When the cutoff frequencies of the highpass filters 11,12,13 and the lowpass filters 17,18 are $f_{c11}$, $f_{c12}$, $f_{c13}$, $f_{c17}$, and $f_{c18}$ respectively, their relation is expressed by:

$$f_{c12} < f_{c11} = f_{c13} < f_{c17} = f_{c18} \quad (4)$$

Figure 4A:
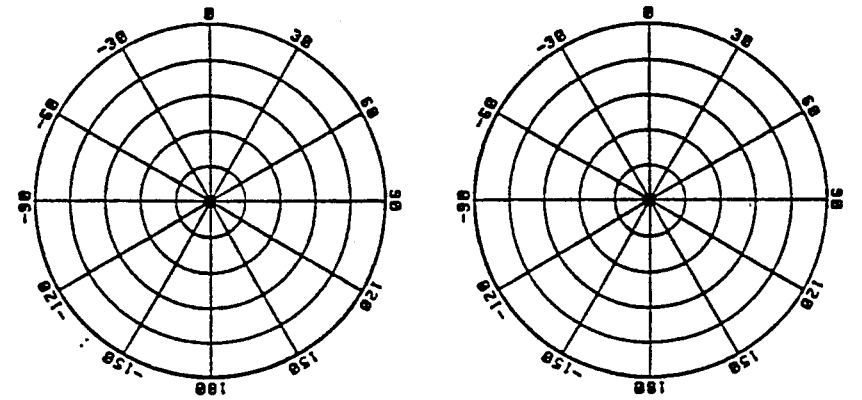
FIG. 4*a* is a diagram showing directivity patterns of the microphone apparatus of FIG. 3 in a low frequency region.
Figure 4B:
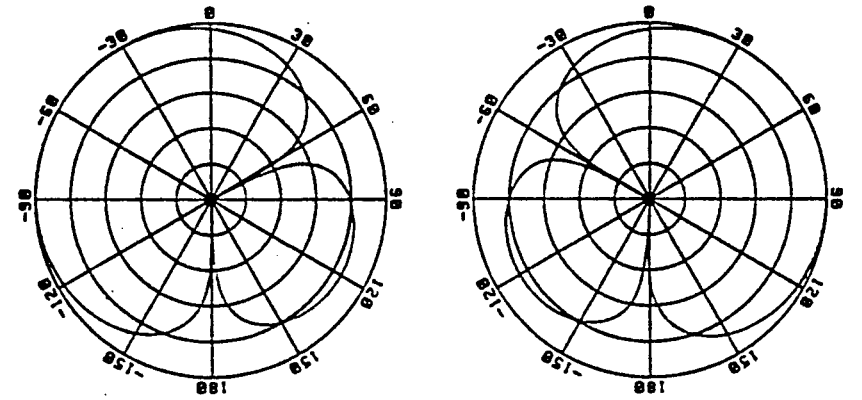
FIG. 4*b* is a diagram showing directivity patterns of the microphone apparatus of FIG. 3 in a high frequency region.

The microphone apparatus of the second embodiment is arranged for stereo sound recording, in which a right sound channel is consisted of the two non-directional microphones 8 and 9 and a left sound channel is consisted of the two non-directional microphones 9 and 10. The operation of each sound channel is identical to that of the microphone apparatus of the first embodiment. FIG. 4*a* illustrates a directivity pattern of the microphone apparatus of the second embodiment in a lower frequency range than $f_{c11}$ or $f_{c13}$. FIG. 4*b* illustrates a directivity pattern of the microphone apparatus of the second embodiment in a higher frequency range than $f_{c11}$ or $f_{c13}$.

As described, the microphone apparatus of the second embodiment acts as a non-directional microphone for response to a low frequency range and the first order pressure gradient microphone in a high frequency range and can thus attenuate the unwanted wind and vibration noise of low frequencies to as a low level as of the non-directional microphone and also, maintain the noise of high frequencies at a minimum. It would be understood that the microphone apparatus of the second embodiment is arranged for stereo sound pickup and its directivity pattern has to be determined concerning a location of the sound image in reproduction as well as the direction from which a noise sound propagates. When both $f_{c11}$ and $f_{c13}$ are determined to about 200 Hz, the non-directional response will rarely disturb stereo effects in reproduction.

What is claimed is:

1. A microphone apparatus comprising:

first and second non-directional microphones arranged at a distance from each other;

a first highpass filter for eliminating a low frequency component of an output signal of the first non-directional microphone;

a second highpass filter for eliminating a low frequency component of an output signal of the second non-directional microphone;

a phase shifter for phase shifting an output signal of the second highpass filter;

a subtractor for subtracting a phase shifted signal from the phase shifter from an output signal of the first highpass filter; and a lowpass filter for eliminating a high frequency component of an output signal of the subtractor.

2. A microphone apparatus comprising:

first and second non-directional microphones arranged at a distance from each other;

a third non-directional microphone arranged on a line extending perpendicularly from a middle point between the first and second non-directional microphones;

a first highpass filter for eliminating a low frequency component of an output signal of the first non-directional microphone;

a second highpass filter for eliminating a low frequency component of an output signal of the second non-directional microphone;

a third highpass filter for eliminating a low frequency component of an output signal of the third non-directional microphone;

a phase shifter for phase shifting an output signal of the third highpass filter;

a first subtractor for subtracting a phase shifted signal from the phase shifter from an output signal of the first highpass filter;

a second subtractor for subtracting the phase shifted signal from the phase shifter from an output signal of the second highpass filter;

a first lowpass filter for eliminating a high frequency component of an output signal of the first subtractor; and a second lowpass filter for eliminating a high frequency component of an output signal of the second subtractor.

* * * * *